United States Patent [19]

Chippa

[11] 4,025,107

[45] May 24, 1977

[54] COLLAPSIBLE SPOON-BOTTOM CHAIR

[76] Inventor: Charles Chippa, 16 Park Ave., Spring Valley, N.Y. 10977

[22] Filed: Jan. 19, 1976

[21] Appl. No.: 650,367

[52] U.S. Cl. ..... 297/17; 108/116; 248/421; 272/33 A; 297/33; 297/258; 297/345

[51] Int. Cl.[2] ..... A47C 3/029

[58] Field of Search ..... 297/17, 20, 32, 33, 297/38, 51, 56, 258, 261, 344, 345, 381; 211/202; 248/164, 421, 423; 108/116, 117; 272/33 A, 56, 144

[56] References Cited

UNITED STATES PATENTS

| | | | |
|---|---|---|---|
| 317,468 | 5/1885 | Morstatt | 248/421 X |
| 805,846 | 11/1905 | Flindall | 297/20 X |
| 1,366,274 | 1/1921 | Orth | 297/345 |
| 2,770,288 | 11/1956 | Peyton | 297/345 |
| 2,824,600 | 2/1958 | Baumgardner | 297/345 |
| 2,988,358 | 6/1961 | Mills | 272/33 A |
| 2,996,331 | 8/1961 | Clarin | 297/38 |
| 3,022,037 | 2/1962 | Stallard | 248/421 |
| 3,041,070 | 6/1962 | Kerstein | 297/258 X |

FOREIGN PATENTS OR APPLICATIONS

| | | | |
|---|---|---|---|
| 261,013 | 4/1949 | Switzerland | 297/17 |

*Primary Examiner*—Roy D. Frazier
*Assistant Examiner*—William E. Lyddane
*Attorney, Agent, or Firm*—Erwin S. Teltscher

[57] ABSTRACT

A collapsible spoon-bottom chair includes a bowl-shaped bottom, a guide rail attached thereto, scissor-type levers which have two pairs of opposite ends, where one pair of the ends is slidable in the guide rail and an extensible seat which is hingeably attached to the other pair of ends. The seat is movable from a seating position outside the bowl to a collapsed position within the bowl.

6 Claims, 6 Drawing Figures

COLLAPSIBLE SPOON-BOTTOM CHAIR

BACKGROUND OF THE INVENTION

1. Field of the Invention

The invention relates to a collapsible chair having a spoon or bowl-type bottom.

2. Description of the Prior Art

Various devices, notably rockable amusement and physical exercise or fitness devices, rocker toys and garden stools are known which have a spoon or bowl-type bottom and are rockable. No device is known though which has a spoon-type bottom, is rockable and also collapsible within the spoon-type bottom.

SUMMARY OF THE INVENTION

In view of the proven use and demand for a rockable chair, and the well-known advantages in portability and compactness of a collapsible version of a chair, it is therefore the object of the present invention to devise a spoon-bottom chair, which is collapsible within the spoon or bowl-shaped bottom and therefore easily portable.

I accordingly provide a spoon-bottom chair which includes a bowl-shaped bottom, a guide rail attached thereto, scissor-type levers with two pairs of opposite ends, where one pair of said ends is slidable in the guide rail and an extensible seat which is hingeably attached to the other pair of said ends. The seat is movable from a seating position outside the bowl to a collapsed position within the bowl.

It is advantageous if second scissor-type levers, substantially identical with the first scissor-type levers are provided and two crossbars connect both scissor-type levers. In the latter version of the chair, a second guide rail is attached to the bottom and disposed in parallel with the first guide rail, one pair of ends of the second scissor-type levers being slidable in the second guide rail. The other pair of ends of the second scissor-type levers is hingeably attached to the extensible seat.

Each of the guide rails is preferably formed with a multiplicity of recesses; the pair of ends of the scissor-type levers slidable in the guide rails are then formed with respective projections which can be placed in four respective recesses, so that the height of the extensible seat above the bowl is adjustable.

The extensible seat preferably includes a tube and a pair of bars slidable in opposite directions within the tube; the other pair of ends of the first scissor-type levers is hingeably attached to the pair of bars. In an advantageous further development of the present invention a second tube is disposed in parallel with the first tube, and a second pair of bars is slidable in opposite directions with the second tube. The second tube and the second pair of bars is substantially identical with the first tube and the first pair of bars, respectively. The other pair of ends of the second scissor-type levers is hingeably attached to the second pair of bars.

The chair, according to the present invention, is preferably provided with a backrest hingeably attached to the first pair of bars and is movable from the seating position to the collapsed position; at least one arm rest is slidably attached to the back-rest, and at least one arm-rest supporting member is hingeably attached to the extensible seat and to the arm rest. The backrest is preferably formed with an arcuate slot, the upper end of the arcuate slot being formed with a part-circular recess. The arm-rest supporting member is preferably formed with an extension bar which can be placed in the arcuate slot and in the part-circular recess. The backrest is in the seating position when the extension bar rests in the part-circular recess, and in the collapsed position when the extension bar rests in the lower end of the arcuate slot.

The extensible seat preferably comprises first and second transverse rods integral with the first and second pairs of bars, and a flexible pad attached to the transverse bars. The bottom is preferably formed with an elongated slot for facilitating gripping thereof; the backrest preferably includes a hinge attached thereto and closable over the second tube in the collapsed position.

BRIEF DESCRIPTION OF THE DRAWING

My invention will be better understood with reference to the accompanying drawing in which.

DESCRIPTION OF THE PREFERRED EMBODIMENT

Figure 1:
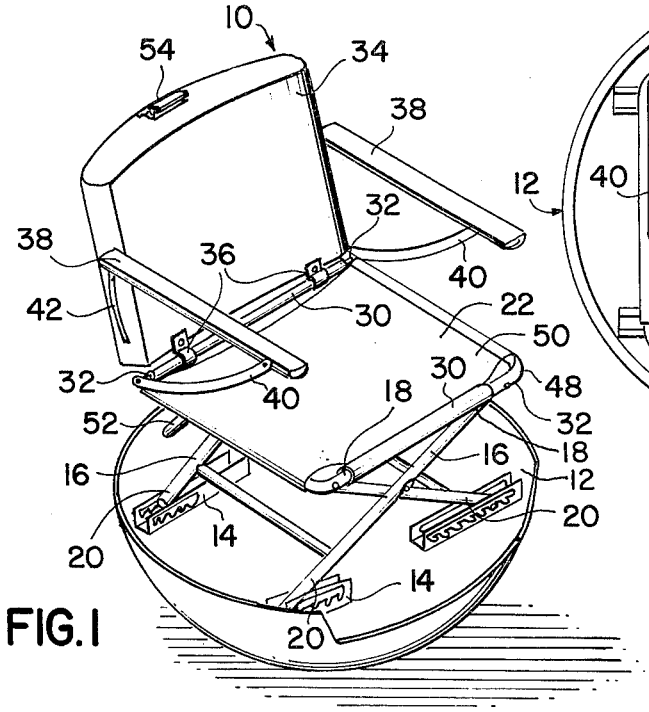
FIG. 1 shows a perspective view of the spoon-bottom chair, according to my invention, in the seating position.
Figure 5:
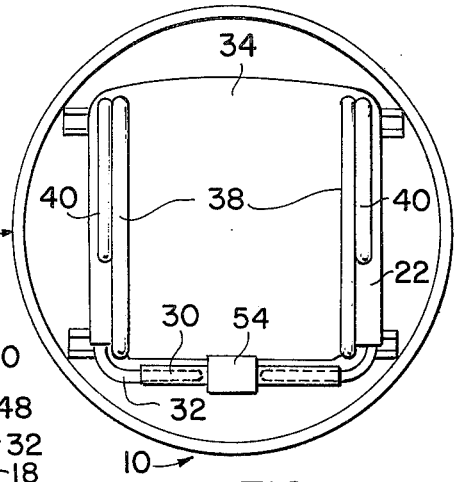
FIG. 5 shows a plan view of the chair in the collapsed position.

Referring now to the drawing, a spoon-bottom chair 10 includes a bowl-shaped bottom 12, guide rails 14 attached thereto, the guide rails being disposed parallel to one another, and two pairs of scissor-type levers 16 each individual lever 16 having opposite ends 18 and 20; the ends 20 are slidable in the guide rails 14. An extensible seat 22 is hingeably attached to the ends 18 of the scissor-type levers 16 so that the seat 22 is movable from a seating position, as shown in FIG. 1, to a collapsed position within the bowl 12, as shown in FIG. 5, and as denoted by the dotted line of part of the scissor-type levers 16 in FIG. 4. Two cross-bars 24 rigidly connect the scissor-type levers 16.

Figure 4:
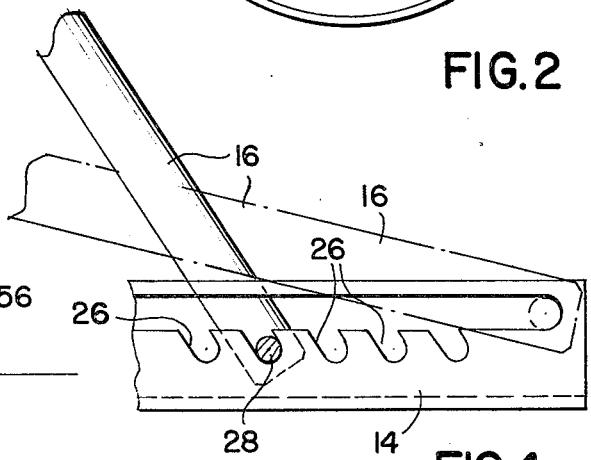
FIG. 4 shows a detail of the guide rail of the chair in elevation.

The guide rails 14 are formed with a multiplicity of recesses 26, as can best be seen from FIG. 4, and the pair of ends 20 are formed with two projections 28, which are placeable in respective recesses 26. Symmetrical placement of the two projections 28 in appropriate recesses 26 of the guide rails 14 permits an adjustment of the height of the chair 10.

The extensible seat 22 includes two tubes 30 and two pairs of bars 32 slidable in opposite directions within respective tubes 30, the ends 18 of the scissor-type levers 16 being hingeably attached to respective bars 32.

Figure 6:
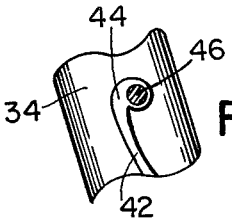
FIG. 6 shows an enlarged detail of FIG. 5 with an arm rest removed.
Figure 2:
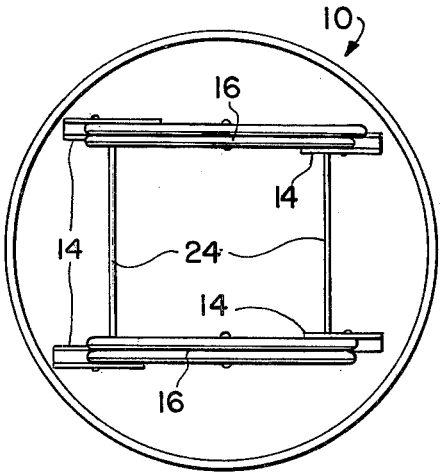
FIG. 2 shows a plan view of the chain with the extensible seat and backrest removed and in the collapsed position.
Figure 3:
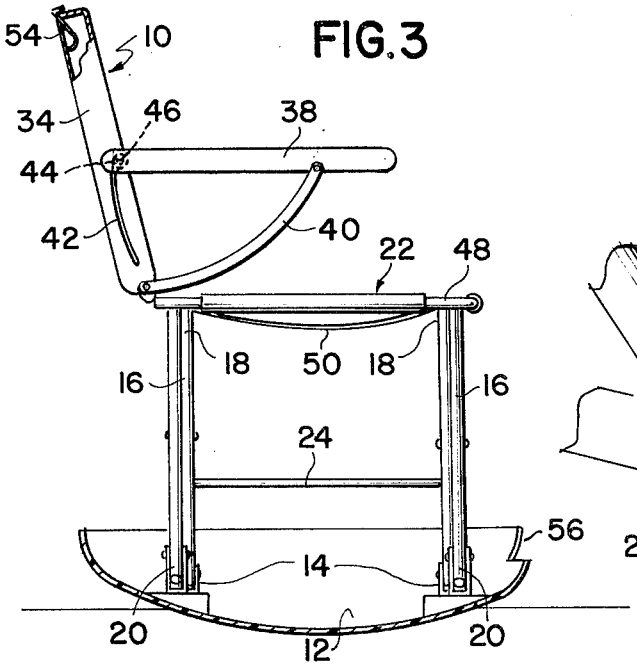
FIG. 3 shows a side elevation of the chair in part cross-section.

A backrest 34 is attached by means of hinges 36 to the rear tube 30; two arm rests 38 are slidably attached to the backrest 34 and two arm rest supporting members 40 are hingeably attached to respective arm rests 38 and to the extensible seat 10 at the rear bars 32. The backrest 34 is formed with two arcuate slots 42; the upper end of each slot 42 has a part-circular recess 44, best seen in FIG. 6. The arm rest supporting members 40 are formed with extension bars 46, placeable in respective slots 42 and part-circular recesses 44. The backrest 34 is in the seating position when the extension bars 46 are placed in part-circular recesses 44, respectively, and in a collapsed position when the extension bars 46 rest in the lower ends of the arcuate slots 42.

The extensible seat 22 includes transverse rods 48 which are integral with the bars 32 to form an extensible rectangular-shaped seat support. A flexible pad 50 is attached to the transverse bars 48. The bowl 12 is formed with an elongated slot 52, best seen in FIG. 1 for facilitating gripping thereof, and the backrest 34 is provided with latch means 54 attached thereto, which are closable over the front tube 30 when the chair 10 is in a collapsed position, so that the chair does not inadverently open, when in that position. The bowl 12 is additionally formed with a recess 56 opposite the elongated slot 12 to permit room for the feet of a person sitting on the chair 10.

Although the invention has been described with respect to a preferred form thereof, it is to be understood that it is not to be limited since changes can be made therein which are within the full intended scope of this invention as defined by the appended claims.

What is claimed is:

1. A spoon-bottom chair comprising:

a bowl-shaped bottom;

a first pair of rails attached thereto;

a pair of scissor-type levers, each of said levers having first and second ends, said first ends being slidable in a respective one of said guide rails, said guide rails being formed with a multiplicity of recesses, each of said first ends being formed with two projections placeable within two of said recesses, respectively;

an extensible seat hingeably attached to said second ends, said seat being movable from a seating position outside of said bowl to a collapsed position within said bowl, said seat comprising a first tube and a first pair of bars slidable in opposite directions within said tube, each of said first pair of bars including a transverse rod integral therewith, each of said second ends of said levers being hingeably attached to a respective one of said first pair of bars;

a second pair of scissor-type levers substantially identical with the first pair of scissor-type levers, each lever of said second pair of levers having third and fourth opposite ends;

two crossbars rigidly connecting both scissor-type levers; and a second pair of guide rails attached to said bottom and disposed in parallel with the first pair of guide rails, said third ends being slidable in said second pair of guide rails, said fourth ends being hingeably attached to a respective one of said transverse rods, whereby the height of said extensible seat above said bowl is adjustable.

2. A spoon-bottom chair according to claim 1 further comprising a second tube disposed in parallel with the first tube and a second pair of bars slidable in opposite directions within said second tube and integral with a respective one of said transverse rods, said second tube and said second pair of bars being substantially identical with the first tube and the first pair of bars, respectively, said fourth ends being hingeably attached to said second pair of bars.

3. A spoon-bottom chair according to claim 2 further comprising:

a back-rest hingeably attached to said first tube and movable from a seating position to said collapsed position;

at least one arm rest slidably attached to said backrest; and at least one arm rest supporting member hingeably attached to said extensible seat and to said armrest.

4. A spoon-bottom chair according to claim 3 wherein said backrest is formed with an arcuate slot having upper and lower ends, said upper end being formed with a part-circular recess, and wherein said arm rest supporting member is formed with an extension bar placeable in said arcuate slot and in said part-circular recess, whereby said backrest is in said seating position upon said extension bar resting in said part-circular recess, and in said collapsed position upon said extension bar resting in said lower end of said arcuate slot.

5. A spoon-bottom chair according to claim 4 wherein said extensible seat further comprises a flexible pad attached to said transverse rods.

6. A spoon-bottom chair according to claim 5 wherein said bottom is formed with an elongated slot for facilitating gripping thereof and a recess opposite said slot and wherein said backrest further comprises latch means attached thereto and closable over said second tube in said collapsed position.

* * * * *